US007159427B2

(12) United States Patent
Schroth et al.

(10) Patent No.: US 7,159,427 B2
(45) Date of Patent: Jan. 9, 2007

(54) HEATED AND INSULATED TOOL CONTAINER FOR HOT GAS BLOW-FORMING

(75) Inventors: James Gregory Schroth, Troy, MI (US); Richard Murray Kleber, Clarkston, MI (US); Richard Harry Hammar, Utica, MI (US); Edward W. Bennett, Clarkston, MI (US)

(73) Assignee: General Motors Corporation, Detroit, MI (US)

( * ) Notice: Subject to any disclaimer, the term of this patent is extended or adjusted under 35 U.S.C. 154(b) by 216 days.

(21) Appl. No.: 10/788,931

(22) Filed: Feb. 27, 2004

(65) Prior Publication Data

US 2005/0188734 A1 Sep. 1, 2005

(51) Int. Cl.
*B21D 26/02* (2006.01)

(52) U.S. Cl. ..... 72/60; 72/342.92; 100/326

(58) Field of Classification Search ..... 72/342.7, 72/342.8, 342.92
See application file for complete search history.

(56) References Cited

U.S. PATENT DOCUMENTS

| | | | | |
|---|---|---|---|---|
| 3,551,952 | A * | 1/1971 | Morse | 100/321 |
| 4,352,280 | A * | 10/1982 | Ghosh | 72/38 |
| 5,277,045 | A * | 1/1994 | Mahoney et al. | 72/60 |
| 5,277,047 | A * | 1/1994 | Herdzina | 72/342.92 |
| 5,553,474 | A * | 9/1996 | Nokajima et al. | 72/60 |
| 6,810,709 | B1 * | 11/2004 | Hammar et al. | 72/342.7 |

* cited by examiner

*Primary Examiner*—Lowell A. Larson
*Assistant Examiner*—Debra Wolfe
(74) *Attorney, Agent, or Firm*—Kathryn A. Marra

(57) ABSTRACT

Apparatus for hot gas blow-forming including opposed heated and insulated tool containers, each including a tool heater plate that is adapted for attachment to a platen of a press with one or more load bearing spacers interposed between the tool heater plate and the platen. Each tool container also includes an insulation enclosure having a base portion that is interposed between the tool heater plate and the platen and further having perimeter wall portion that surrounds the tool heater plate. A perimeter seal is preferably attached to at least one of the heated and insulated tool containers and is adapted for sealing engagement with the other of the heated and insulated tool containers.

10 Claims, 2 Drawing Sheets

HEATED AND INSULATED TOOL CONTAINER FOR HOT GAS BLOW-FORMING

TECHNICAL FIELD

The present invention generally relates to hot gas blow-forming of metal alloy sheet blanks into articles of complex curvature such as automotive body panels. More particularly this invention relates to a heated tool container for use in super-plastic-forming (SPF) or quick-plastic-forming (QPF) processes.

BACKGROUND OF THE INVENTION

Automotive body panels are typically produced by forming low carbon steel or aluminum alloy sheet stock into desired panel shapes, often by conventional room temperature processes such as stamping. Such body panels, however, can also be produced by hot gas blow-forming processes, such as SPF. Compared to conventional stamping processes, SPF processes are capable of producing more complex panel shapes from a single sheet of material. SPF processes involve complex integrally heated presses and low material deformation rates that yield cycle times typically between 20 and 60 minutes. Such relatively long cycle times are incompatible with automotive production rates. Also, because SPF heat sources are remotely located from SPF forming tool surfaces, SPF processes do not provide a high degree of temperature control at the workpiece.

Therefore, QPF processes were developed to reduce the cycle time of SPF and to provide better temperature control closer to forming tool surfaces by attaching insulation to, and embedding heating elements within, the forming tools themselves. Providing insulation and heating elements in each forming tool, however, requires a lead time to produce QPF forming tools and increases the costs thereof. Such investment costs are recoverable by suitable production volumes. With lower volume production runs, however, internally or integrally heated hot forming tools may be too expensive.

Accordingly, SPF and QPF processes are not optimized for every type of hot gas blow-forming production situation including low cycle time prototyping or other low-volume production. Thus, there is a need for a hot gas blow-forming apparatus that avoids the expense and lead times associated with integrally heated tooling, and avoids the long cycle times and lack of localized temperature control of SPF heated press processes.

SUMMARY OF THE INVENTION

The present invention meets these needs by providing an improved apparatus for hot gas blow-forming including opposed heated and insulated tool containers. Each tool container is adapted to hold, heat, and insulate a relatively low cost hot forming tool that does not have to contain internal heating elements.

Each of the tool containers includes a tool mounting plate that is adapted for attachment to a platen of an unheated press with one or more load bearing spacers interposed between the tool mounting plate and the platen. Each tool container also includes an insulation enclosure having a base portion that is interposed between the tool mounting plate and the platen and further having a perimeter wall portion that surrounds the tool mounting plate. In combination, the insulation enclosures and the mounting plates define individually heated and insulated tool enclosures in an open and opposed position. In further combination, and in their respective individually closed positions, the insulation enclosures and the mounting plates define a closed heated and insulated tool vessel or container. A perimeter seal is preferably attached to at least one of the heated and insulated tool containers and is adapted for sealing engagement with the other of the heated and insulated tool containers. Thus, each tool is individually heated by its respective heated mounting plate. Each tool is insulated from the press platen to which it is attached, and, in the closed position of the press, the combination of forming tools is insulated from the environment external to the tooling. Thus, this invention provides a lower cost method of heating tools and maintaining such tools at desired temperatures for hot gas blow-forming.

In contrast to the prior art, the press itself and the major sub-elements of the press are not integrally heated. Likewise, the forming tools themselves are not integrally heated nor insulated. Rather, the investment expense and lead time required to provide such insulation and heating elements are borne by the dedicated heated and insulated tool enclosures of the present invention. Thus, the expense and lead time associated with such auxiliary apparatus can be eliminated from each individual set of forming tools that are swapped in and out of the reusable containers.

BRIEF DESCRIPTION OF THE DRAWINGS

These and other features and advantages of the invention will become apparent upon reading the detailed description in combination with the accompanying drawings, in which.

DESCRIPTION OF THE PREFERRED EMBODIMENT

In general, the present invention provides an apparatus for hot gas blow-forming a blank of sheet metal into a formed component. The apparatus includes at least one dedicated insulation vessel in which a dedicated heating means is disposed. The apparatus is flexibly adapted for mounting a variety of relatively simple and inexpensive forming tools therein. The forming tools do not require any separate insulating or heating means to be assembled thereto or therein. Accordingly, the investment cost of providing the insulating and heating means is spread out amongst a multitude of forming tools, thereby reducing the lead time and cost to produce hot gas blow-forming tools.

Figure 1:
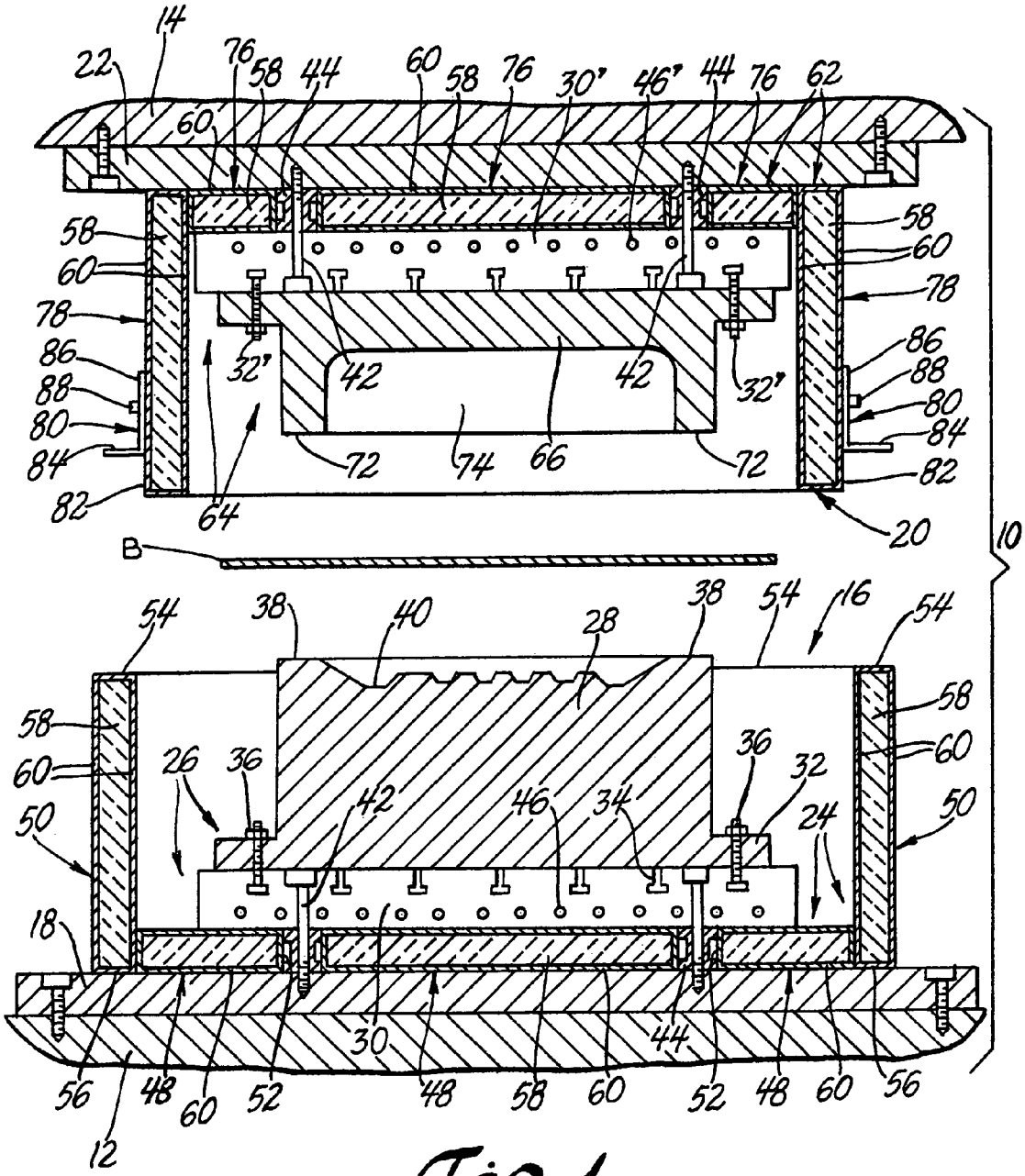
FIG. 1 is a cross-sectioned side view illustrating a press and tooling apparatus in an open position according to an embodiment of the present invention.

Referring specifically now to the Figures, there is illustrated in FIG. 1 a press and tooling apparatus 10 for hot gas blow-forming of a sheet metal blank B. The apparatus 10 is in an open position and generally includes a press bed 12, a movable press ram 14 positioned vertically opposed to and above the press bed 12, a lower tooling and insulation apparatus 16 mounted to the press bed 12 via a lower platen 18 mounted therebetween to the press bed 12, and an upper tooling and insulation apparatus 20 mounted to the press ram 14 via an upper platen 22 mounted therebetween. The press operates to vertically move the press ram 14, thereby moving the upper tooling and insulation apparatus 20 toward the lower tooling and insulation apparatus 16 to establish an insulated hot gas blow-forming environment in which work is performed on the sheet metal blank B, as will be described in more detail below. In other words, the lower and upper tooling and insulation apparatuses 16, 20, in combination, define a closed insulated tooling vessel. In contrast to typical SPF processes, none of the press bed 12, press ram 14, and platens 18, 22 of the present invention are heated. Accordingly, a conventional, unmodified hydraulic press may be used to carry out the present invention, thereby reducing the complexity and cost of hot gas blow-forming processes.

The lower tooling and insulation apparatus 16 generally establishes a lower half of the closed insulated tooling vessel and also provides a means for defining a desired part geometry for the sheet metal blank B. The apparatus 16 includes a lower insulation enclosure 24 that laterally circumscribes and, thus, at least partially insulates a lower tool apparatus 26 therein. The term enclosure is consistent with the terms vessel and barrier, and is defined herein to mean a structure that at least partially surrounds something else.

The lower tool apparatus 26 is defined by a lower forming tool 28 that is mounted to a heater/mounting plate 30 using any type of desired fasteners such as bolts 32. The bolts 32 anchor within T-slots 34 milled in the mounting plate 30, extend through a portion of the lower forming tool 28, and are held by a nut 36 thereto. A plurality of such T-slots 34 are provided in a variety of locations on the mounting plate 30 so as to accommodate different forming tools of various sizes and shapes. The lower forming tool 28 includes a binder surface 38 atop which the sheet metal blank B is initially placed and a forming surface 40 against which the sheet metal blank B is eventually blow-formed into a desired part configuration. As shown, the binder surface 38 is generally flat or planar, but may alternatively be nonplanar, or angular. The forming tool 28 may be composed of any suitable SPF material, such as P20 tool steel or the like.

The mounting plate 30 is mounted to the lower platen 18 by fasteners 42 that, as shown, extend through load bearing spacers 44, which serve to space the mounting plate 30 a predetermined distance away from the lower platen 18. Alternatively, the mounting plate 30 need not be fastened directly to the lower platen 18, but instead may be trapped between the lower platen 18 and the form tool 28, which may be fastened directly to the lower platen 18. In such case, the mounting plate 30 would function solely as an intermediate heater plate. In any case, the spacers 44 are any type of load bearing element and may be spool-shaped as shown, block-shaped, or the like and are preferably composed of Inconel® 718 or the like. The quantity and size of the spools 44 are predetermined for any given press so as to allow the entire press tonnage to be applied to the lower forming tool 28. For example, ten spools of two to three inches in diameter and about four inches in height could be used.

Functionally, the mounting plate 30 is provided for different purposes. First, it provides a heat source for carrying out the hot gas blow-forming process. The mounting plate 30 is integrally heated, such as by a plurality of heating elements 46 that are embedded therein and that are preferably electrical resistance heating elements. The mounting plate 30, however, may be integrally heated by any other type of desired heating means. Second, the mounting plate 30 is an adaptable means for mounting a variety of different forming tools thereto and includes the plurality of T-slots 34 to this end. Such mounting plates 30 are typically custom manufactured for each application. In any case, use of such an intermediate plate permits a wide variety of forming tooling of different shapes and sizes to be quickly and accurately swapped in and out of the lower insulation enclosure 24. Accordingly, the same insulation enclosure 24 and mounting plate 30 can be reused among many different tooling setups and production runs for many different parts. Use of this configuration thereby avoids the need to provide each different set of forming tools with insulation packs and embedded resistance heating elements, thereby decreasing the complexity and cost of the forming tools. Between the lower tooling apparatus 26 and the lower platen 18, there is positioned a base portion 48 of the lower insulation enclosure 24. As an assembly, the load-bearing spools 44 and the base portion 48 define a load-bearing portion of the lower insulation enclosure 24.

The lower insulation enclosure 24 insulates the lower platen 18 from the lower tooling apparatus 26 via the base portion 48 and also insulates the surrounding shop environment from the heat generated by the mounting plate 30 via a perimeter wall 50 that extends in a generally perpendicular direction away from the base portion 48. In other words, the insulation enclosure 24 is provided to efficiently maintain a high working temperature within its confines as well as to maintain a lower ambient temperature on the outside of the insulation enclosure 24, preferably on the order of less than 130° F. The base portion 48 may be a single slab-shaped element or panel that is trapped between the lower platen 18 and mounting plate 30 and has apertures 52 therein to accommodate the spacers 44 therethrough. Alternatively, the base portion 48 could be constructed of an assembly of load-bearing spools surrounded by stainless steel encased insulation, or the base portion 48 could include slabs of load bearing insulation distributed amongst the load-bearing spools. The base portion 48 may also be separately attached to the lower platen 18 if desired.

The perimeter wall 50 laterally surrounds the tool apparatus 26 except for a portion of the lower forming tool 28 including the binder surface 38 thereof which may be located just vertically above a top surface 54 of the perimeter wall 50 for ease of locating the sheet metal blank B to the forming tool 28. Alternatively, the perimeter wall 50 could be provided such that the top surface 54 extends vertically above the binder surface 38. The perimeter wall 50 is preferably constructed of four separate slab-like elements or panels that are about five inches in thickness and that are arranged to form a rectangular-shaped perimeter. The perimeter wall 50 may be separately attached to the base portion 48 at a bottom end 56 of the perimeter wall 50. Each panel of the insulation enclosure 24 may be composed of an inner core or layer of non-load-bearing blanket insulation 58 that is encased within a rigid shell 60. The rigid shell 60 is relatively non-load-bearing but is at least self-supporting and is preferably composed of 304 stainless steel sheet. Blanket insulation 58 is readily commercially available, such as Cer-Wool RT available from Premier Refractories and Chemicals, Inc. of King of Prussia, Pa. The panels are preferably insulated from one another using woven glass tape (not shown) therebetween to minimize heat transfer among the panels. The rigid shells 60 of adjacent panels are preferably attached with machine screws that pass through slotted holes to allow relative motion between the panels. Alternatively, the base portion 48 could be constructed in a different manner than the perimeter walls 50. In other words, the base portion 48 may instead consist of loose, non-load-bearing insulation that is distributed between the spools 44 and protected with one or more loosely located sheets of stainless steel. Again, the base portion 48 may also consist of a slab of load-bearing ceramic insulation.

The upper tooling and insulation apparatus 20 is substantially similar in construction and composition to the lower tooling and insulation apparatus 16. Functionally, however, the upper tooling and insulation apparatus 20 serves somewhat different purposes. The apparatus 20 generally establishes an upper half of the closed insulated vessel or hot gas blow-forming environment, and provides a means for binding the sheet metal blank B against the binder surface 38 of the lower forming tool 28 and a means for defining a pressure chamber above the sheet metal blank B. The apparatus 20 includes an upper insulation vessel or enclosure 62 and an upper tool apparatus 64.

The upper tool apparatus 64 is defined by an upper forming tool 66 that is mounted to a heater/mounting plate 30' that is identical to the mounting plate 30 of the lower tool apparatus 26. The mounting plate 30' is integrally heated with built-in heaters 46'. The upper forming tool 66, as shown, is simply a cover and does not provide a forming surface against which the sheet metal blank B is formed. It is contemplated, however, that the upper forming tool 66 could provide a forming surface if desired, which is consistent with double-action types of forming tools. In any case, the upper forming tool 66 includes a binder surface 72 for binding the sheet metal blank B against the binder surface 38 of the lower forming tool 28 and also includes a cavity 74 to define a pressure chamber for blow-forming the sheet metal blank B against the forming surface 40 of the lower forming tool 28. The cavity 74 may be much shallower than as shown in the drawing figures. Between the upper tool apparatus 64 and the upper platen 22, there is positioned a base portion 76 of the upper insulation enclosure 62. As an assembly, the load-bearing spools 44 and the base portion 76 define a load-bearing portion of the upper insulation enclosure 62.

The upper insulation enclosure 62 insulates the upper platen 22 from the tool apparatus 64 via the base portion 76 and insulates the shop environment from the hot tool apparatus 64 via a perimeter wall 78. The perimeter wall 78 laterally surrounds the tool apparatus 64. The base portion 76 is preferably a single slab-like element or panel that is trapped between the upper platen 22 and the mounting plate 30' and has apertures therein to accommodate spacers 44. Like the lower perimeter wall 50, the upper perimeter wall 78 is preferably constructed of four separate slab-like elements or panels that are arranged to form a rectangular-shaped perimeter. The perimeter wall 78 may be attached to the base portion 76. Each panel of the insulation enclosure 62 is composed of the blanket insulation material 58 that is encased within the rigid shell 60.

A perimeter seal 80 is attached to exterior sides 82 of the upper insulation enclosure 62 to limit convective currents within the closed heated and insulated tool vessel or container. The perimeter seal 80 may be a flexible tadpole seal, or the seal 80 may be constructed of four individual stainless steel segments (not shown) that overlap or abut at lateral ends thereof to provide a circumferentially continuous sealing element. However, it is contemplated that the perimeter seal 80 could be a one-piece element, such as a cylindrical element in the case where the insulation enclosure 62 is cylindrical in shape. In any event, the perimeter seal 80 is L-shaped in cross section and includes a solid sealing portion 84 and a slotted body portion 86 through which a fastener 88 extends. Accordingly, the perimeter seal 80 can be vertically adjusted so as to ensure good sealing contact of the sealing portion 84 against the top surfaces 54 of the lower insulation enclosure 24 when the press ram 14 is lowered.

Figure 2:
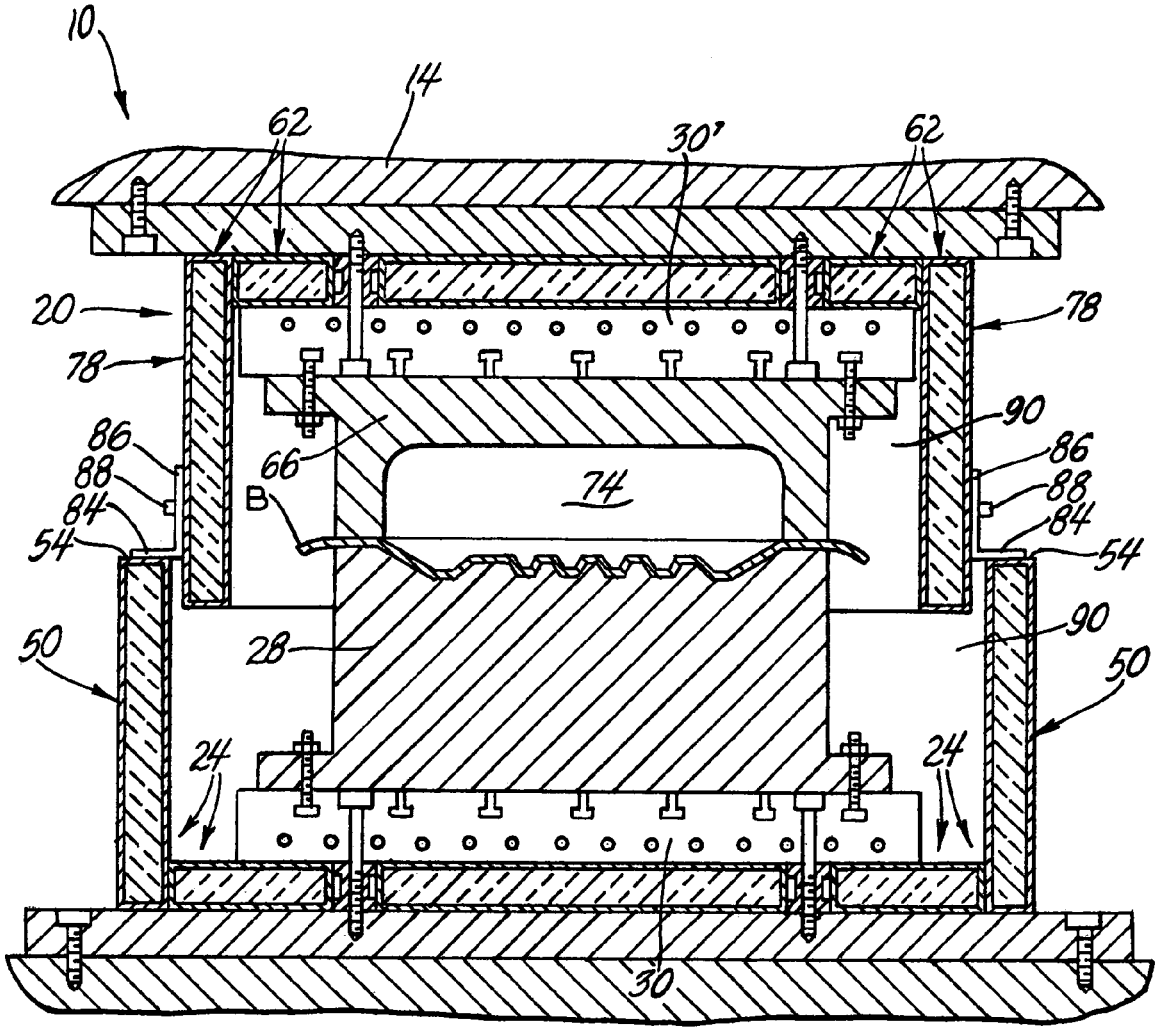
FIG. 2 is a cross-sectional side view illustrating the press and tooling apparatus of FIG. 1 in a closed position.

Referring now to FIG. 2, the apparatus 10 is shown in a closed position such that the press ram and upper tooling and insulation apparatus 20 occupy a lowered position. The lower insulation enclosure 24 is sized so as to accept a portion of the open end of the upper insulation enclosure 62 within a portion of the open end of the lower insulation enclosure 24. Accordingly, there is vertical overlap of the perimeter walls 50, 78 as shown. Accordingly, the overlap accommodates variation in the tooling shut height, such that a variety of different tooling can be swapped in and out of the insulation enclosures 24, 62. In order to seal the peripheral gap between the lower and upper insulation enclosures 24, 62, the sealing portion 84 of the perimeter seal 80 is in sealing contact with the top surfaces 54 of the lower insulation enclosure 24. The perimeter seal 80 may be firmly fastened to the upper insulation enclosure 62 or may be permitted to float in a vertical direction to accommodate slight variations in tooling shut height.

In a sense, the insulation enclosures 24, 62 form a "hatbox" type of container. In the lowered and sealed position, the upper and lower insulation enclosures 62, 24 and perimeter seal 80 combine to define a closed and sealed hot blow-forming vessel that is insulated and thereby defines an insulated interior 90. As such, the closed vessel provides a thermally efficient hot gas blow-forming environment and protects the workspace surrounding the press from excessive temperatures. Alternatively to the configuration shown in the drawing figures, the larger insulation enclosure could be provided on the top and the smaller insulation enclosure on the bottom, such that the bottom enclosure would fit within the confines of the top enclosure. In this way, the convective currents within the enclosures would be better maintained to reduce the need for a seal therebetween.

In any event, once the upper tooling and insulation apparatus 20 is lowered and sealed against the lower tooling and insulation apparatus 16, the hot gas blow-forming process may proceed in accordance with known techniques. For example, pressurized gas may be introduced into the cavity 74 or pressure chamber of the upper form tool 66 to form the sheet metal blank B against the lower form tool 28. The apparatus of the present invention is preferably operated in accordance with QPF-types of process parameters such as those disclosed in U.S. Pat. No. 6,253,588 to Rashid et al., which is assigned to the assignee hereof and which is incorporated by reference herein. It is further contemplated that the principles of the present invention apply to any types of forming tool designs including single action forming tools, double-action forming tools, and the like.

In combination, the insulation enclosures 24, 62 and the mounting plates 30, 30' define individual heated and insulated tool vessels in an open and opposed position. In further combination and in their respective individually closed positions, the insulation enclosures 24, 62 and the mounting plates 30, 30' define a closed heated and insulated tool vessel or container.

Advantageously, the press and major sub-elements thereof are unheated and the forming tooling is also unheated. In other words, the press and tooling are not integrally heated in the sense that heating elements or other heating means are not embedded therein. Rather, a dedicated mounting plate is positioned intermediate the press and tooling, and is integrally heated within a dedicated insulated enclosure. The combination of the heated mounting plates and the insulated enclosure vessel in close proximity to the tooling enables forming cycle times that are similar to that of QPF, but avoids the costs and long lead times of providing QPF tooling. This is because the dedicated heated and insulated tool vessels can be reused to accommodate a wide multitude of forming tools. In other words, the investment expense and lead time of providing insulation and heating elements in close proximity to the forming tool surfaces can be borne by a single, dedicated heated and insulated tool vessel. Thus, such auxiliary apparatus and expense thereof can be eliminated from each of the multitudes of forming tools that are swapped in and out of the vessel. Specifically, it is estimated that a 25% reduction in tooling costs can be achieved as well as a 33% reduction in forming tool lead time.

It should be understood that the invention is not limited to the embodiments that have been illustrated and described herein, but that various changes may be made without departing from the spirit and scope of the invention. Accordingly, it is intended that the invention not be limited to the disclosed embodiments, but that it have the full scope permitted by the language of the following claims.

What is claimed is:

1. An apparatus for hot gas blow-forming within a press, said apparatus comprising:

a first heater plate for mounting to said press, said first heater plate being integrally heated;

a first forming tool mounted to said first heater plate, such that said first forming tool is separately heated by said first heater plate;

a first insulation enclosure including a base portion positioned between said first heater plate and said press, said first insulation enclosure further including a perimeter wall surrounding said first heater plate and at least a portion of said first forming tool;

a second heater plate mounted to said press in opposed relationship to said first heater plate, said second heater plate being integrally heated;

a second forming tool mounted to said second heater plate, such that said second forming tool is separately heated by said second heater plate; and a second insulation enclosure including a base portion positioned between said second heater plate and said press, said second insulation enclosure further including a perimeter wall surrounding said second heater plate and at least a portion of said second forming tool, wherein said apparatus closes together such that a portion of one of said insulation enclosures fits within a portion of the other of said insulation enclosures to define a closed insulation vessel so as to insulate said forming tools from the surrounding environment.

2. An apparatus as claimed in claim 1 further comprising a perimeter seal mounted to one of said insulation enclosures for sealing engagement with the other of said insulation enclosures, wherein said perimeter seal mounts to the side of said one of said insulation enclosures and seals against the top of said other of said insulation enclosures.

3. An apparatus as claimed in claim 1 further comprising at least one load-bearing spacer positioned between at least one of said first and second heater plates and said press.

4. An apparatus as claimed in claim 1 wherein at least one of said first and second insulation enclosures comprises non-load-bearing insulation.

5. An apparatus as claimed in claim 1 wherein at least one of said first and second heater plates is mounted to said press via a platen mounted therebetween and to said press.

6. An apparatus as claimed in claim 1 wherein at least one of said first and second heater plates includes electrical resistance heating elements therein.

7. An apparatus as claimed in claim 1 wherein said press and said first and second forming tools are not integrally heated.

8. An apparatus for a hot blow-forming process within a press, said apparatus comprising:

a heated and insulated tool container including:

a tool heater plate adapted for attachment to a platen of said press;

at least one load bearing spacer interposed said tool heater plate and said platen;

an insulation enclosure having:

a base portion interposed said tool heater plate and said platen; and a perimeter wall portion extending in a substantially perpendicular direction away from said base portion and surrounding said tool heater plate; and a forming tool mounted to said tool heater plate, such that said forming tool is separately heated by said tool heater plate; and a second heated and insulated tool container opposed to said heated and insulated tool container, said second heated and insulated tool container including:

a second tool heater plate adapted for attachment to an opposed platen of said press;

at least one load bearing spacer interposed said second tool heater plate and said opposed platen;

a second insulation enclosure having:

a base portion interposed said second tool heater plate and said opposed platen; and a perimeter wall portion extending in a substantially perpendicular direction away from said base portion and surrounding said second tool heater plate; and a second forming tool mounted to said second tool heater plate, such that said second forming tool is separately heated by said second tool heater plate; and a perimeter seal attached to at least one of said heated and insulated tool containers and adapted for sealing engagement with the other of said heated and insulated tool containers;

wherein said forming tools are individually heated by respective said tool heater plates and are insulated from said press, further wherein said apparatus closes together such that a portion of one of said insulation enclosures fits within a portion of the other of said insulation enclosures to define a closed insulation vessel so as to insulate said forming tools from the surrounding environment.

9. An apparatus for hot gas blow-forming within a press having a press bed and an opposed press ram, said apparatus comprising:

an integrally heated heater plate mounted to said press bed;

a layer of insulation positioned between said integrally heated heater plate and said press bed;

a second integrally heated heater plate mounted to said press ram;

a second layer of insulation positioned between said second integrally heated heater plate and said press ram;

a forming tool mounted to said integrally heated heater plate, said forming tool being separately heated by said integrally heated heater plate;

a second forming tool mounted to said second integrally heated heater plate, said second forming tool being separately heated by said second integrally heated heater plate; and first and second insulation enclosures respectively at least partially surrounding said heater plates and said forming tools so as to insulate heater plates and said forming tools from the outside environment such that, when said apparatus is closed for hot gas blow-forming, a portion of one of said insulation enclosures fits within a portion of the other of said insulation enclosures to insulate said forming tools from the environment.

10. An apparatus as claimed in claim 9, further comprising a perimeter seal attached to one of said insulation enclosures.

* * * * *